US006494182B1

(12) United States Patent
Djordjevic

(10) Patent No.: US 6,494,182 B1
(45) Date of Patent: Dec. 17, 2002

(54) SELF-REGULATING GASOLINE DIRECT INJECTION SYSTEM

(75) Inventor: Ilija Djordjevic, East Granby, CT (US)

(73) Assignee: Stanadyne Automotive Corp., Windsor, CT (US)

( * ) Notice: Subject to any disclaimer, the term of this patent is extended or adjusted under 35 U.S.C. 154(b) by 0 days.

(21) Appl. No.: 09/638,286

(22) Filed: Aug. 14, 2000

Related U.S. Application Data

(63) Continuation-in-part of application No. PCT/US00/04096, filed on Feb. 17, 2000.
(60) Provisional application No. 60/120,546, filed on Feb. 26, 1999.

(51) Int. Cl.[7] ..... F02M 41/00
(52) U.S. Cl. ..... 123/456; 123/447
(58) Field of Search ..... 123/447, 456, 123/450, 446, 494; 73/119 A

(56) References Cited

U.S. PATENT DOCUMENTS 5,676,114 A * 10/1997 Tarr et al. ..... 123/446
6,293,251 B1 * 9/2001 Hemmerlein et al. ..... 123/447
6,345,609 B1 * 2/2002 Djordjevic ..... 123/509

FOREIGN PATENT DOCUMENTS

DE 198 22 164 A 11/1999

* cited by examiner

*Primary Examiner*—Willis R. Wolfe
*Assistant Examiner*—Mahmoud Gimie
(74) *Attorney, Agent, or Firm*—Alix, Yale & Ristas, LLP

(57) ABSTRACT

A self-regulating direct injection fuel delivery system for a motor vehicle includes a common rail having an accumulator including a relatively large fuel volume. The accumulator is connected in fluid communication with a distributor having a relatively small fuel volume and at least one fuel injector nozzle is connected in direct fluid communication with the distributor. A high-pressure pump for delivering fuel to the common rail is provided and a flow control device is interposed between the pump and the common rail for selectively delivering fuel to one of the accumulator and the distributor and then the other of the accumulator and the distributor.

8 Claims, 16 Drawing Sheets

SELF-REGULATING GASOLINE DIRECT INJECTION SYSTEM

REFERENCE TO RELATED APPLICATION

This is a Continuation-In-Part of PCT Application No. PCT/US00/04096 filed Feb. 17, 2000, designating the United States, which entered the U.S. National Phase as application Ser. No. 09/913,661 and issued as U.S. Pat. No. 6,422,203, and which claimed priority under 35 U.S.C. §119 (e) from U.S. provisional application No. 60/120,546 filed on Feb. 26, 1999.

BACKGROUND OF THE INVENTION

The present invention relates to fuel pumps and, more particularly, to fuel pumps and rail systems for supplying fuel at high pressure for injection into an internal combustion engine.

Current gasoline direct injection systems have a relatively low overall pumping efficiency because, e.g., they employ a constant output pump that is sized for the maximum required output. The excess fuel pressurized by the pump passes through a dumping type pressure regulator and subsequently returned to the pump inlet or the fuel tank. As the fuel passes through the pressure regulator, the fuel depressurizes releasing energy in the form of heat. Accordingly, a significant amount of energy is wasted pressurizing unused fuel.

In a typical direct fuel injection system, a high-pressure (up to 120 bar) supply pump is employed which pressurizes fuel received from a low-pressure circuit (2 to 4 bar) including, e.g., a fuel tank and a low-pressure fuel pump. An accumulator is typically fluidly connected to the high-pressure pump and fuel regulators are fluidly connected to the accumulator.

The accumulator provides a reservoir of fuel that is pressurized by the pump. The accumulator has to fulfill two main tasks: First is subsidizes the pump output during the injection event, enabling the injection system to inject fuel at a rate higher than pumping rate and second to attenuate pressure pulsation caused by the instantaneous pumping rate variation as well as by pressure waves created by abrupt fuel velocity changes during opening and closing of the injectors.

The rail volume is a compromise between two contradictory requirements. On one hand relatively large accumulator volume is desirable to minimize pressure drop during the injection event (caused by withdrawal of fuel amount larger than supplied by the pump) and also to provide high degree of pressure pulsation attenuation in order to enable the electronic to access the average pressure in the rail, necessary for calculation of the correct injection duration and also to insure more or less uniform injection rate. If for example injection pressure would drop substantially during the injection, the fuel amount metering accuracy, atomization and also droplet penetration into combustion chamber where the pressure already started to rise due to combustion of the initially injected fuel and by that adversely affecting engine performance and emissions.

On the other hand, it would be desirable the keep accumulator volume relatively small to accelerate pressure transients, especially at low speed, where the pump output over time is the lowest.

During extreme low temperature start conditions (−30 to −40 C.) substantially more fuel has to be injected as not all fuel droplets remain airborne and evaporate before the spark plug is triggered and also relatively high injection pressure is necessary to provide sufficiently fine atomization.

However, during such cold start conditions the cranking speed is very likely to be lower than and under higher temperature, partly because of higher viscosity of engine lubricants causing higher resistance against turning and partially because of reduced capacity of the electric battery.

Because of that an accumulator optimized for operation between idle and rated speed under "normal" temperature could turn to be too large during the above low speed cold cranking conditions, extending the cranking time or even compromising the starting altogether.

Accordingly, it is desirable to reduce the quality of fuel during cranking necessary to increase of the pressure in the rail by reducing of the accumulator volume.

SUMMARY OF THE INVENTION

In accordance with one embodiment of the present invention, a self-regulating direct injection fuel delivery system for a motor vehicle includes a common rail that has an accumulator which includes a relatively large fuel volume. The accumulator is connected in fluid communication with a distributor that has a relatively small fuel volume and at least one fuel injector nozzle is connected in direct fluid communication with the distributor. A high pressure pump delivers fuel to the common rail and flow control means are interposed between the pump and the common rail for selectively delivering fuel to one of the accumulator and the distributor and then the other of the accumulator and the distributor.

In accordance with a particular embodiment of the present invention, the flow control means controls both a first flow path between the pump and the distributor and a second flow path between the pump and the accumulator. A pressure control valve is situated in a third flow path between the accumulator and the distributor. The pressure control valve prevents flow from the distributor to the accumulator but permits flow from the accumulator to the distributor when the pressure in the accumulator exceeds the pressure in the distributor by a predetermined differential.

In accordance with another particular embodiment, the pump has an inlet and a discharge, and the flow control means comprises a supply flow path wherein the pump discharge is selectively connected in fluid communication with the first flow path or the second flow path. A bypass flow path may also be provided wherein the pump discharge is selectively connected in fluid communication with the pump inlet.

In accordance with further particular embodiments, the flow control means comprises a control valve for aligning the pump discharge with the first flow path, the pump discharge with the second flow path, and the pump discharge with the bypass flow path. The control valve may comprise a first operator disposed within the first flow path and a second operator cooperatively engageable with the first operator and being disposed within the second flow path. At less than a first predetermined pressure, the second operator is biased into engagement with the first operator so that the first operator aligns the pump discharge with the first flow path only. At greater than the first predetermined pressure, the second operator is urged away from engagement with the first operator thereby aligning the pump discharge with the second flow path. Once a second predetermined pressure is exceeded, the second operator moves to a location wherein the pump discharge is aligned with the bypass flow path.

In accordance with another embodiment of the present invention, a split rail fuel injector assembly for a motor vehicle including a high pressure fuel pump for delivering fuel to at least one fuel injector nozzle is provided. The split rail fuel injection system comprises a distributor for distributing fuel having a distributor first inlet, a distributor second inlet and a distributor outlet. The distributor first inlet is connected in fluid communication with the fuel pump and to the at least one fuel injector nozzle and has a distributor internal volume. An accumulator configured to receive fuel from the fuel pump and to selectively pass fuel to the distributor via the distributor second inlet is provided. The accumulator has an accumulator internal volume wherein the distributor internal volume is substantially less than the accumulator internal volume.

In accordance with a further embodiment of the present invention, a common rail fuel injection system for a motor vehicle includes a high pressure fuel pump that has an inlet and a discharge for delivering fuel to at least one fuel injector nozzle. The injector assembly comprises an accumulator connected in fluid communication with the fuel pump, the accumulator having an accumulator internal volume for containing a reservoir of fuel. Flow control means are interposed between the pump and the accumulator for selectively delivering fuel to the accumulator. The flow control means comprises a supply flow path wherein the pump discharge is selectively aligned with the accumulator and a bypass flow path wherein the pump discharge is selectively aligned with the pump inlet.

In accordance with another embodiment of the present invention, a common rail fuel injection system for a motor vehicle includes a high pressure fuel pump that has an inlet and a discharge for delivering fuel to at least one fuel injector nozzle and a common rail which includes an accumulator connected in fluid communication with a distributor. The fuel injection assembly comprises a flow control device interposed between the pump and the common rail for selectively delivering fuel to one of the accumulator and the distributor and then the other of the accumulator and the distributor. The flow control device controls both a first flow path between the pump and the distributor and a second flow path between the pump and the accumulator. The flow control device comprises a supply flow path wherein the pump discharge is selectively connected to the first flow path or the second flow path and a bypass flow path wherein the pump discharge is selectively connected to the pump inlet. A control valve is provided for selectively aligning the pump discharge with the first flow path, the pump discharge with the second flow path, and the pump discharge with the bypass flow path. The control valve comprises a first operator disposed within the first flow path and a second operator cooperatively engageable with the first operator and being disposed within the second flow path. At less than a first predetermined pressure, the second operator is biased into engagement with the first operator so that the first operator aligns the pump discharge with the first flow path. At greater than a predetermined pressure, the second operator is urged away from engagement with the first operator thereby aligning of the pump discharge with the second flow path. Once a second predetermined pressure is exceeded, the second operator moves to a location wherein the pump discharge is aligned with the bypass flow path.

The invention is another embodiment, is a method of supplying fuel to a plurality of fuel injection nozzles at a target delivery pressure in a distributor rail fluidly connected to each of the nozzles, comprising: maintaining fuel at a pressure above the target delivery pressure in an accumulator having a volume greater than the volume of the distributor rail; maintaining a differential pressure between a higher pressure in the accumulator and the target pressure in the distributor rail, through a fluid connection between the accumulator and the distributor rail; whereby as pressure in the distributor rail begins to drop when the nozzles inject fuel, fuel at the higher pressure of the accumulator flows into the distributor rail to maintain the target pressure therein. The method preferably includes measuring the pressure in the distributor rail; and responsive to said measured pressure and the target pressure in the distributor rail, controlling a variable position valve fluidly connected between the accumulator and the distributor rail to control said fuel flow into the distributor rail.

BRIEF DESCRIPTION OF THE DRAWINGS

The preferred embodiments of the invention will be described below with reference to the accompanying drawings, in which.

DETAILED DESCRIPTION OF THE PREFERRED EMBODIMENTS

Several configurations for a direct injection gasoline supply pump are shown and described in U.S. patent application Ser. No. 09/031,859, filed Feb. 27, 1998 for "Supply Pump For Gasoline Common Rail", the disclosure of which is hereby incorporated herein by reference. The present invention can be considered as particularly well suited for use in conjunction with one or more of the embodiments shown in the application previously incorporated by reference, as well as variations thereof.

Figure 1:
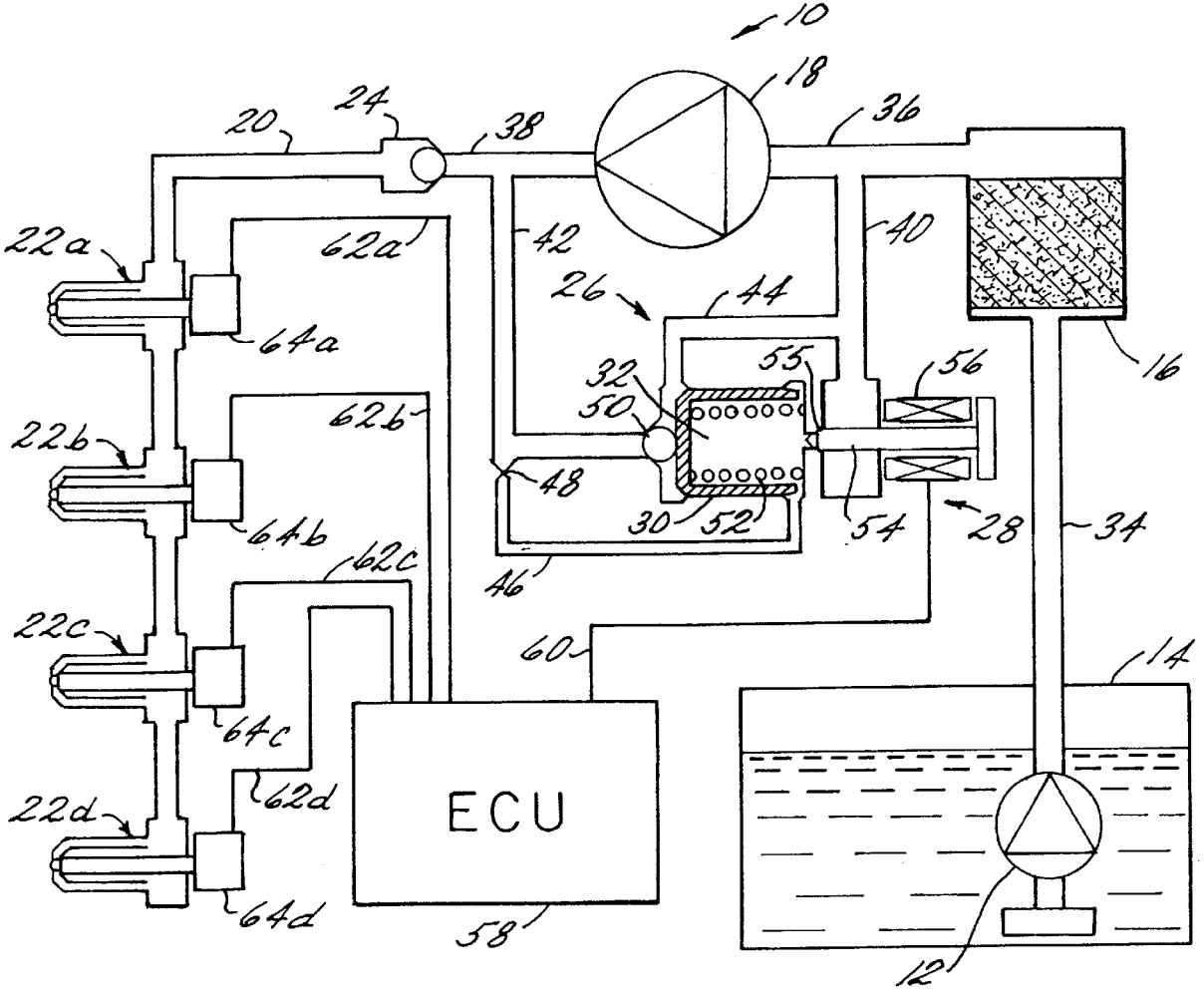
FIG. 1 is a schematic of a first embodiment of a gasoline direct injection system according to the invention.

According to the schematic shown in FIG. 1, gasoline is supplied, via feed line 34 and fuel filter 16, by an electric feed pump 12 at relatively low pressure (under 5 bar, typically 2–4 bar) from the fuel tank 14 to the high pressure fuel supply pump 18. From the high-pressure pump 18 gasoline is supplied to the common rail 20 and from the rail 20 to the individual injectors 22*a*–22*d*. According to the invention, a control valve 28 in a internal hydraulic circuit 26, controls the instantaneous discharge pressure of the pump 18, by diverting and modulating the pressure of the pump discharge flow.

In the embodiment of the hydraulic circuit 26 shown in FIG. 1, piston 30 and associated spring 52 provide a bias on sphere 50, thereby blocking flow between pump inlet passage 36, inlet control passage 40, and first branch passage 44 on the one hand, and pump discharge passage 38 and discharge control passage 42 on the other hand. An orifice 48 provides fluid communication from the discharge control passage 42 to second branch passage 46, which is in fluid communication with control chamber 32 within piston 30. The valve 28, preferably a proportional control valve, has a valve member 54 having a valve surface which bears against valve seat 55 when the valve is fully closed. With the preferred solenoid type valve operator 56, the valve member 54 is normally open but closes upon energizing of the solenoid. The timing and duration of solenoid energization, is controlled by the engine management system (e.g., electronic control unit, ECU 58), via signal path 60. Such control includes the distance by which the valve member 54 shifts toward and away from the seat 55 (i.e., the valve stroke), which is adjustable when a proportional control valve is employed.

The ECU 58 also controls the solenoids 64*a*–64*d* associated respectfully with the injectors 22*a*–22*d*, via signal lines 62*a*–62*d*. Each injection event is controlled at least as to start and duration.

Figure 2:
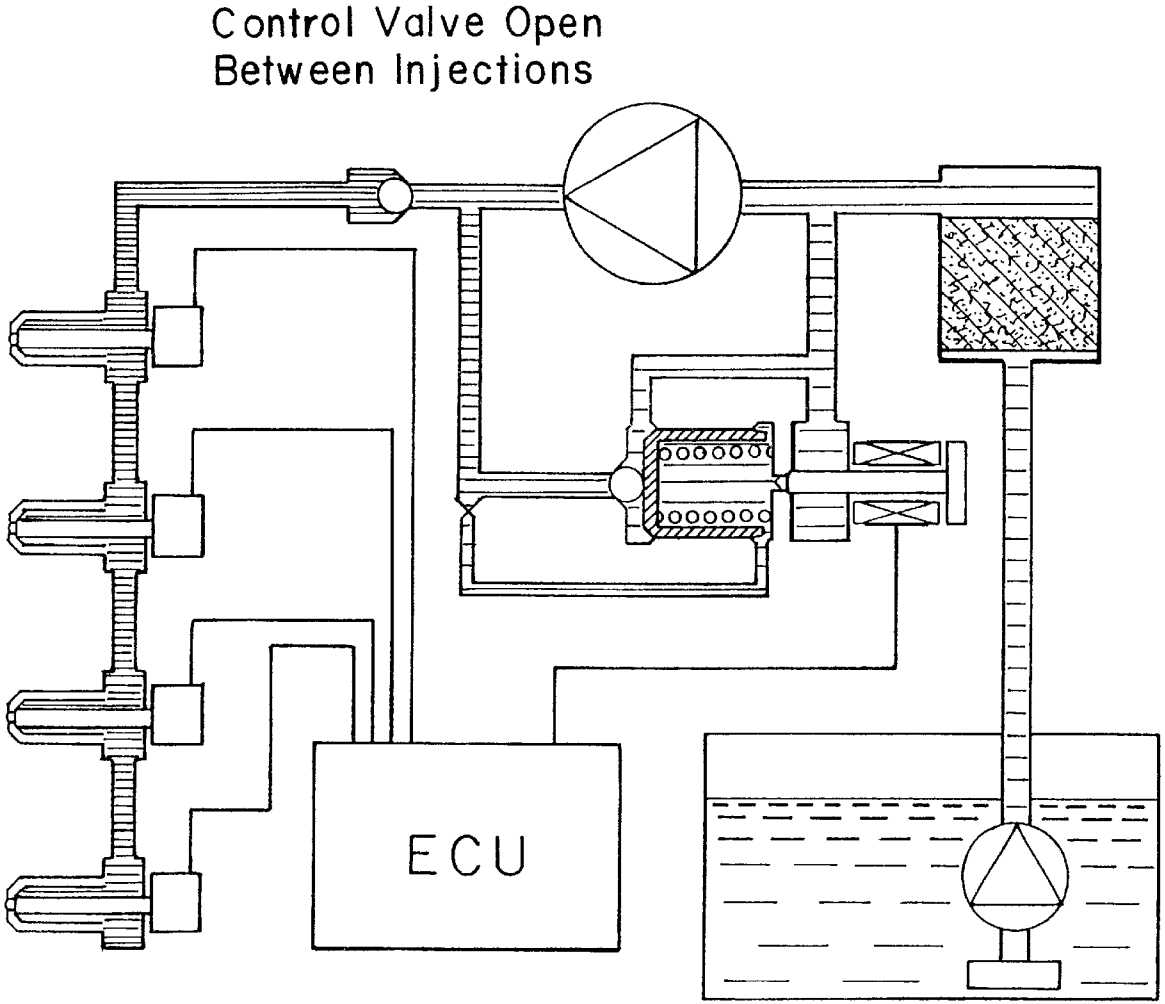
FIG. 2 is a schematic of the embodiment of FIG. 1, between injection events.
Figure 3:
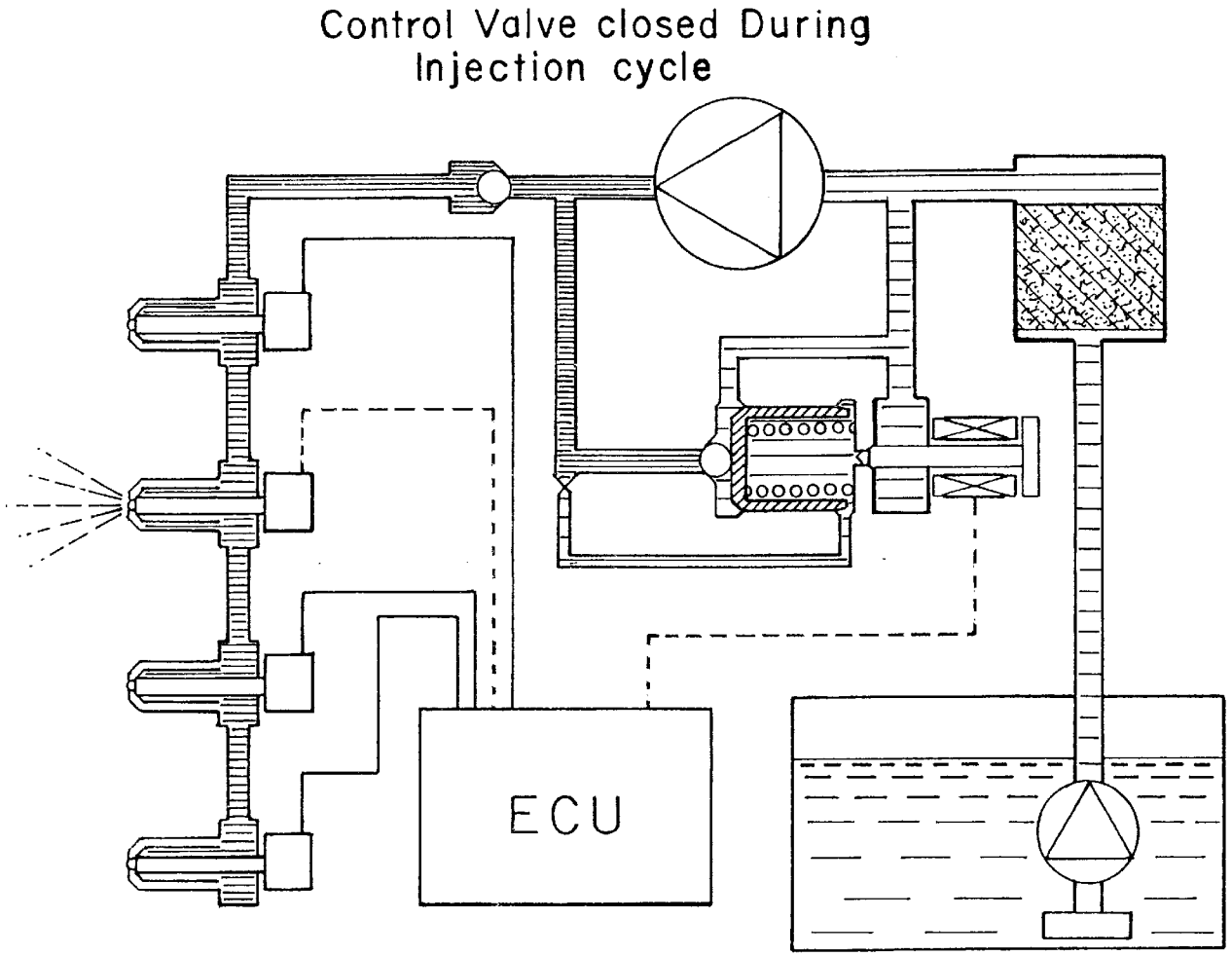
FIG. 3 is a schematic of the embodiment of FIG. 1, during an injection event.

Between the injection events the proportional solenoid valve is substantially open (either completely de-energized or at some reduced duty cycle). The pressure in the control chamber 32 will be low and all the fuel displaced by the high pressure pump will be internally recycled through the pump at some reduced pressure level above the feed pressure but below the high pressure for discharge to the rail. In the embodiment of FIG. 1, this holding pressure between injection events will depend mainly on the piston return spring 52 preload and the back pressure in the control chamber. The low pressure of the feed fuel is less than about 5 bar, the high pressure during steady state operation is greater than about 100 bar, and the holding pressure is preferable in the range of about 10–30 bar. These three pressure regions can be discerned in FIG. 2 from the three different line densities in the various flow passages.

The substantial closing and substantial opening of the valve increases flow resistance and decreases flow resistance, respectively, of the fuel passing through the control circuit along the valve seat. The flow resistance is controlled by varying at least one of the spacing of the valve member 54 from the valve seat 55 and the frequency of changes in the spacing. When the valve is substantially closed, the space is eliminated so that flow resistance is essentially infinite and no flow passes along the seat. When the valve is substantially closed, a non-zero minimum space is maintained, providing a higher resistance than the rest of the control circuit but permitting a low flow passing along the seat.

It should also be appreciated that the piston in the circuit 26 of FIG. 1 is optional, but it acts as a minimum pressure regulator, providing positive torque and "limp home" pressure for the common rail.

Figure 4:
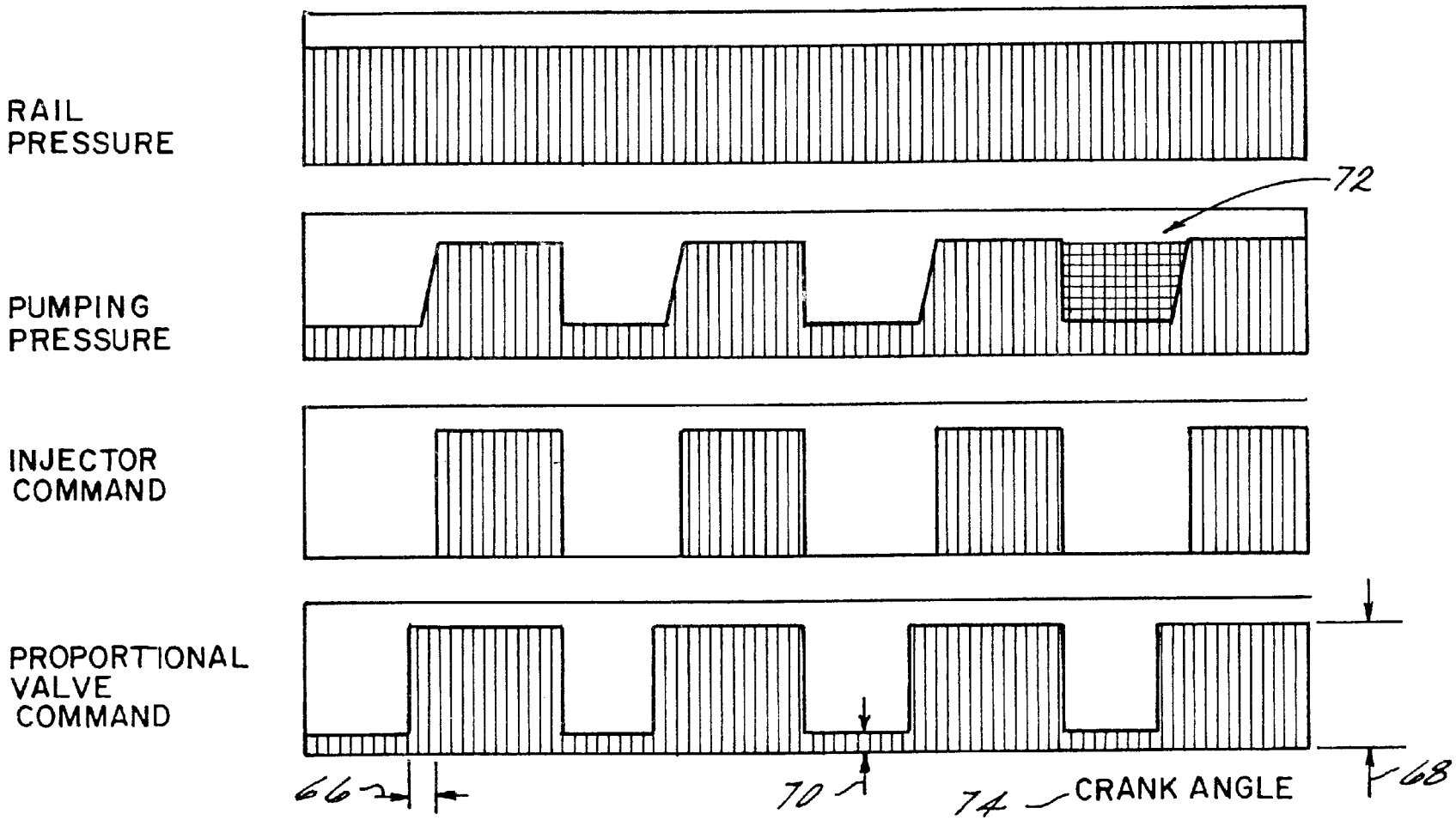
FIG. 4 is a diagrammatic representation of the behavior of the rail pressure, pumping pressure, injector command signal, and proportional control valve signal associated with a first control method for the system of FIG. 1, according to the invention.

FIG. 4 shows the behavior of the rail pressure, supply pump discharge pressure, fuel injector actuation or commend signal, and proportional control valve energizing or commend signal, along a scale corresponding to engine rotation or crank angle 74, during steady state operation of the system shown in FIG. 1. Shortly before the desired start of injection (see phase shift 66) the duty cycle 68 of the proportional solenoid valve is increased above a base or minimum level 70, substantially closing the valve member. The pressure in the piston control chamber 32 will increase as more fuel is supplied through the control orifice 48 than the amount of fuel leaving the control chamber 32 along the proportional valve seat 55. The pressure increase will be gradual because some small amount of fuel is needed to displace the piston and to close or restrict the flow through the proportional valve. Shortly after the desired high-pressure level for the rail is reached, any of the injectors, such as 22*b*, is switched on and gasoline is delivered into the designated engine cylinder. At the end of the injection event the injector solenoid 64*b* and the proportional valve solenoid 56 are switched off simultaneously and the pumping pressure will be reduced accordingly.

Figure 5:
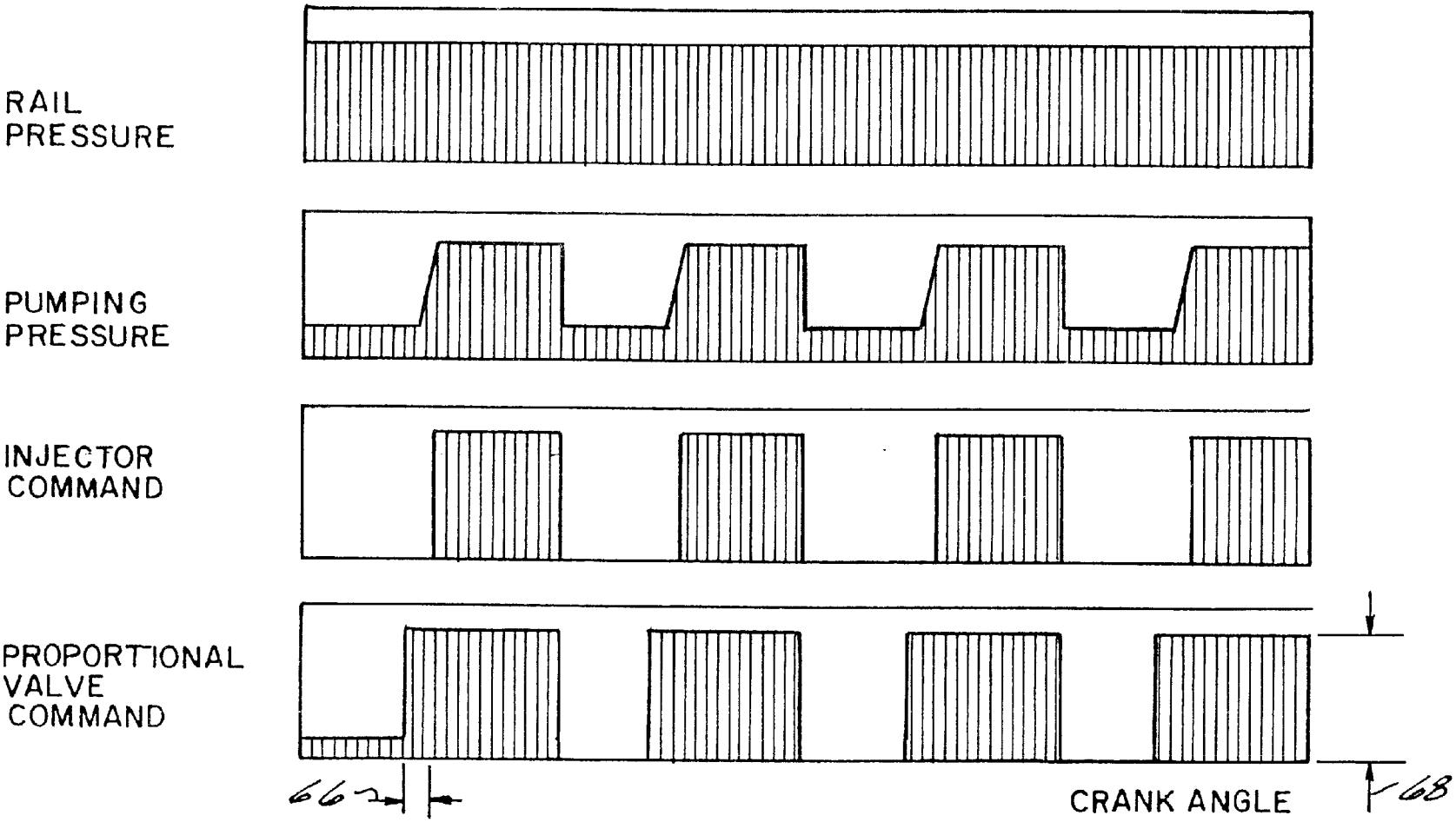
FIG. 5 is a diagrammatic representation of the behavior of the rail pressure, pumping pressure, injector command signal, and proportional control valve signal associated with a second control method for the system of FIG. 1, according to the invention.

FIG. 4 shows the control embodiment wherein the solenoid valve 56 is not fully closed at the end of injection, but is maintained at a low duty cycle to help establish the subsequent holding pressure. FIG. 5 shows another embodiment wherein the solenoid is completely de-energized at the end of the injection event.

In both FIGS. 4 and 5 it can be seen that the control valve begins shifting from the substantially open to the substantially closed condition before actuation of an injector, the control valve remains in the substantially closed condition during actuation of that injector, and the control valve returns to and remains in the substantially open condition simultaneously with the de-energizing of that injector. During steady state operation above idle speed of the engine, the injections are discrete events each beginning on a regular time interval, each event having the same duration which is no greater than, for example, about one-half the regular time interval. Each injection event has a unique holding pressure interval and control valve actuation event associated therewith, and each injection event has a unique high pressure pumping duration associated therewith. Each control valve actuation event and each high pressure pumping duration has a longer duration than the associated injection event. The injection event, the control valve actuation, and the high pressure pumping duration, all terminate substantially simultaneously.

Because the high-pressure pump 18 and the rail 20 are separated by a non-return check valve 24 and because there is no demand for fuel between the injection events, the pressure in the rail will remain more or less constant. The rail, however, does not have capacity to store any significant amount of fuel. Even if the desired pressure was reduced in the mean time, the pressure will drop instantly as soon as the injector opens and the injection will take place at a lower pressure level, determined by a reduced pressure in the control chamber of the intensifier piston. The main advantage of the present invention is that there is always some minimum pumping pressure between the injection events, and the pressure prior to the injection increases gradually. As a result, there will be no torque reversals or zero crossings. Therefore, the pump operation will be very smooth and quiet.

Although the proportional solenoid valve 28 response is relatively slow, this can be compensated for by selection of proper phase shift 66 and of the actuating frequency of the valve member 54. Even with a relatively long phase shift there will always be some net energy savings, as is indicated at 72. Proportional solenoid valves are relatively inexpensive and can be exactly controlled in open loop mode.

Figure 6:
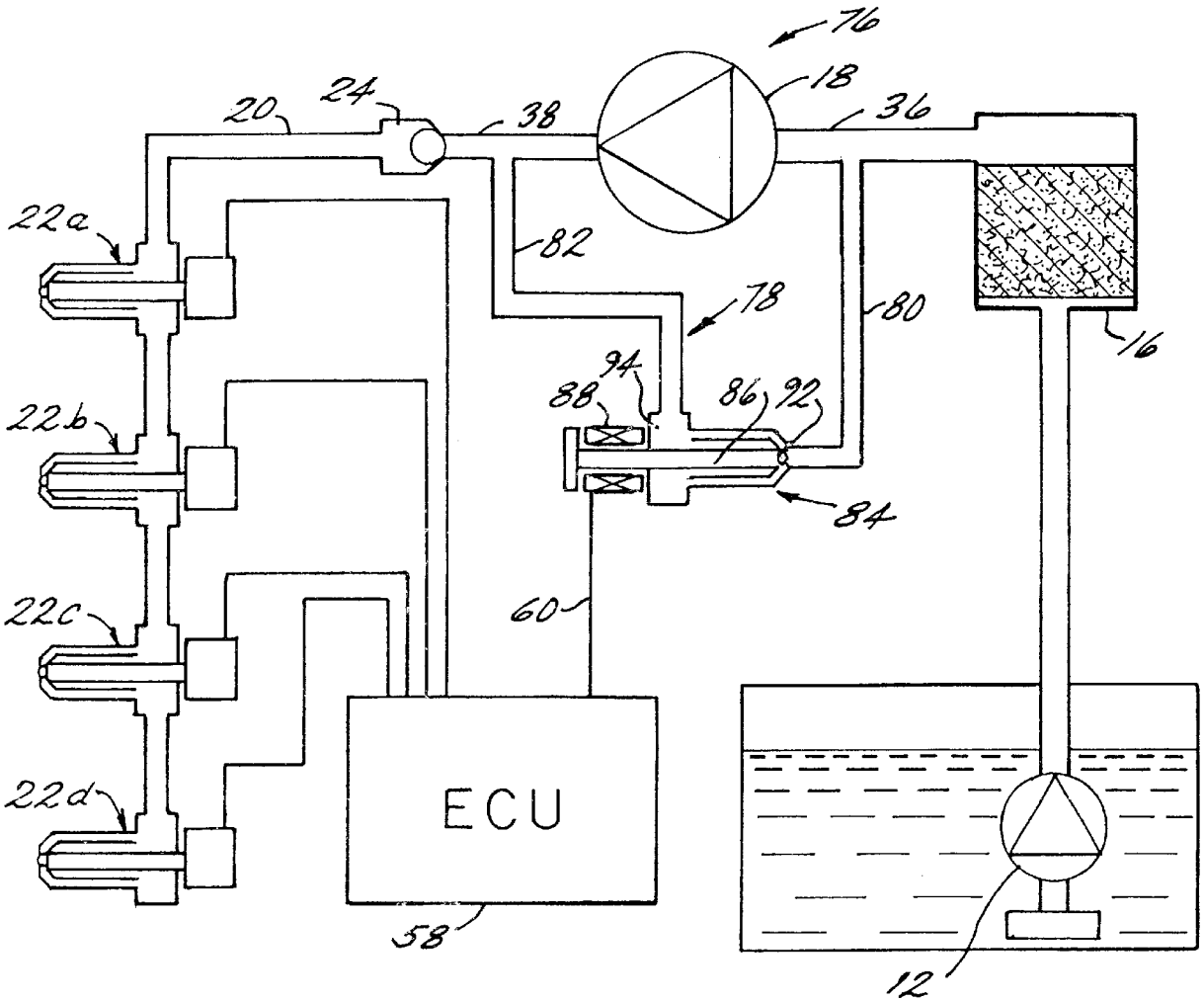
FIG. 6 is a schematic of a second embodiment of a gasoline direct injection system according to the invention.

As shown in the system 76, FIG. 6, if a faster responding hydraulic circuit 78 is desired, an injector (externally) or an injector-like fast solenoid switching valve (internally) 84 can be used as a substitute for valve 28 of FIG. 1. Such valve 84 has a hollow body 90 in fluid communication as by annular chamber 94 with one of the inlet control passage 82 or the discharge control passage 80, a hole 92 in the body, a needle valve member 86 shiftable within the body to open or close the hole as the solenoid 88 operates, and the other of the inlet control passage or the discharge control passage being exposed to the hole. The reduced pressure between the injection events will then depend either from the pressure drop across the switching valve or from a pressure limiting valve which can be installed in series down stream from the switching valve (not shown).

Figure 7:
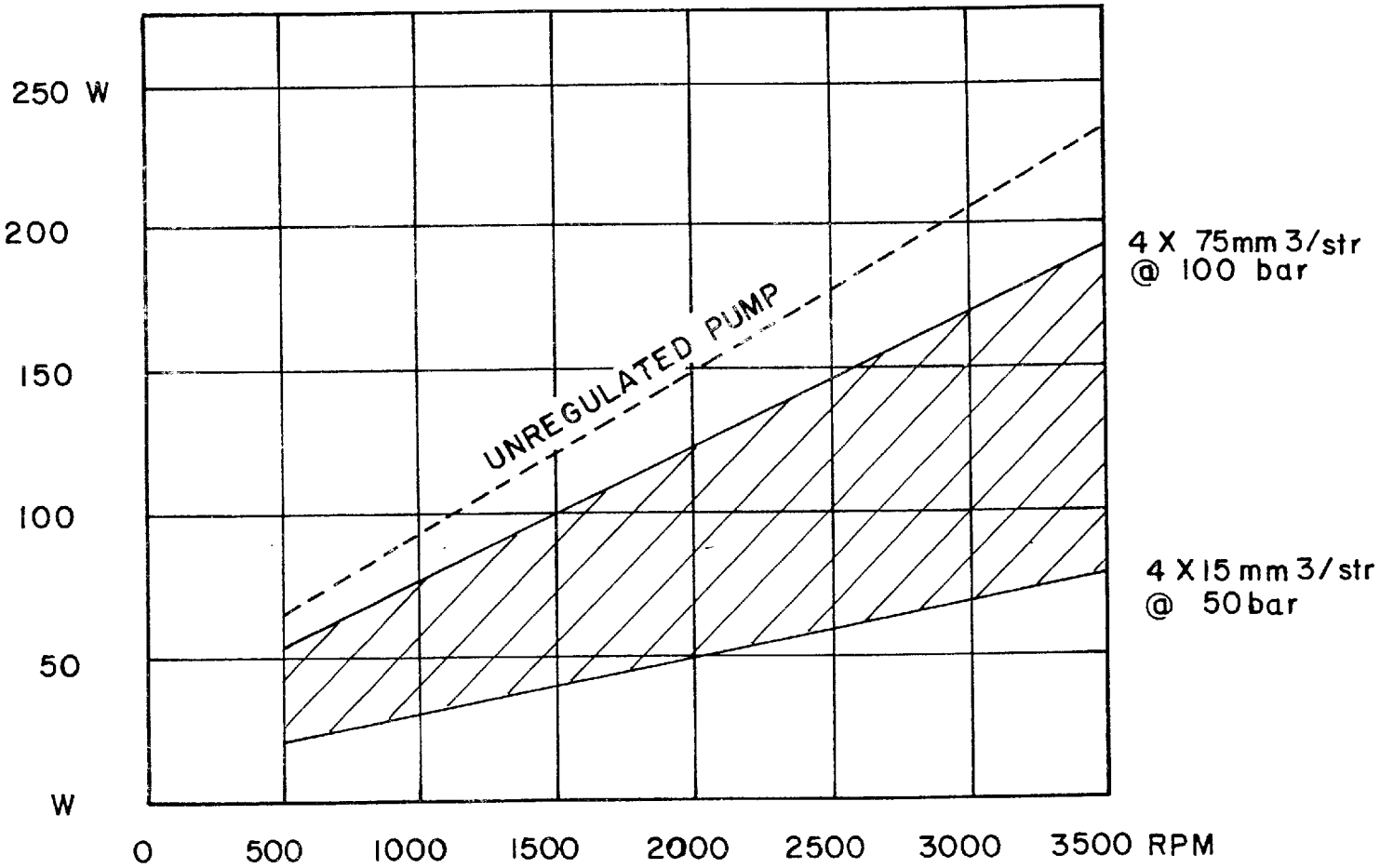
FIG. 7 is a graphical representation of the theoretical power requirement utilizing the variable delivery and injection pressure of the invention relative to an unregulated pump.

FIG. 7 shows an example of power requirements of unregulated versus modulated pump according to the invention. Although theoretical energy saving as shown in FIG. 7 may be diminished because some power is required to operate the solenoid valve, there still will be net positive energy gain. More important, the energy used to operate the solenoid only insignificantly increases gasoline temperature. This is a main objective of this invention, because it allows operation without the necessity to dump previously pressurized fuel and return it into the low-pressure fuel return line and/or without need for a fuel cooler. If output modulation is required, there will always be energy losses, based on fuel flow and force (pressure) level, regardless of what control system (pressure regulating valve, solenoid spill valve in the rail, mechanism changing the eccentricity etc.) is used. One exception is inlet metering, but this system seems to be too inaccurate, too slow and it generates a lot of hydraulic and acoustic noise.

Figure 8:
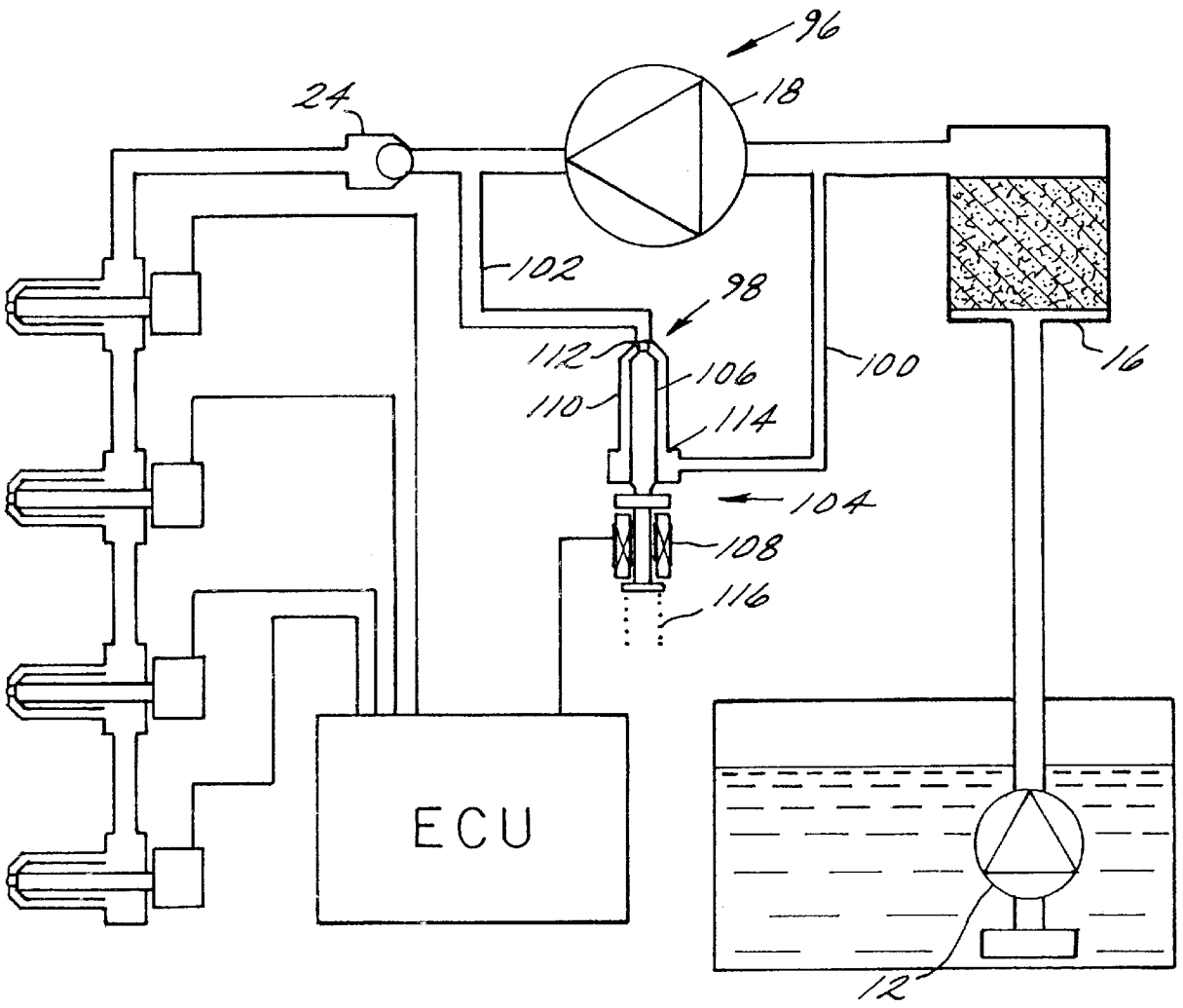
FIG. 8 is a schematic of a third embodiment of a gasoline direct injection system according to the invention.
Figure 9:
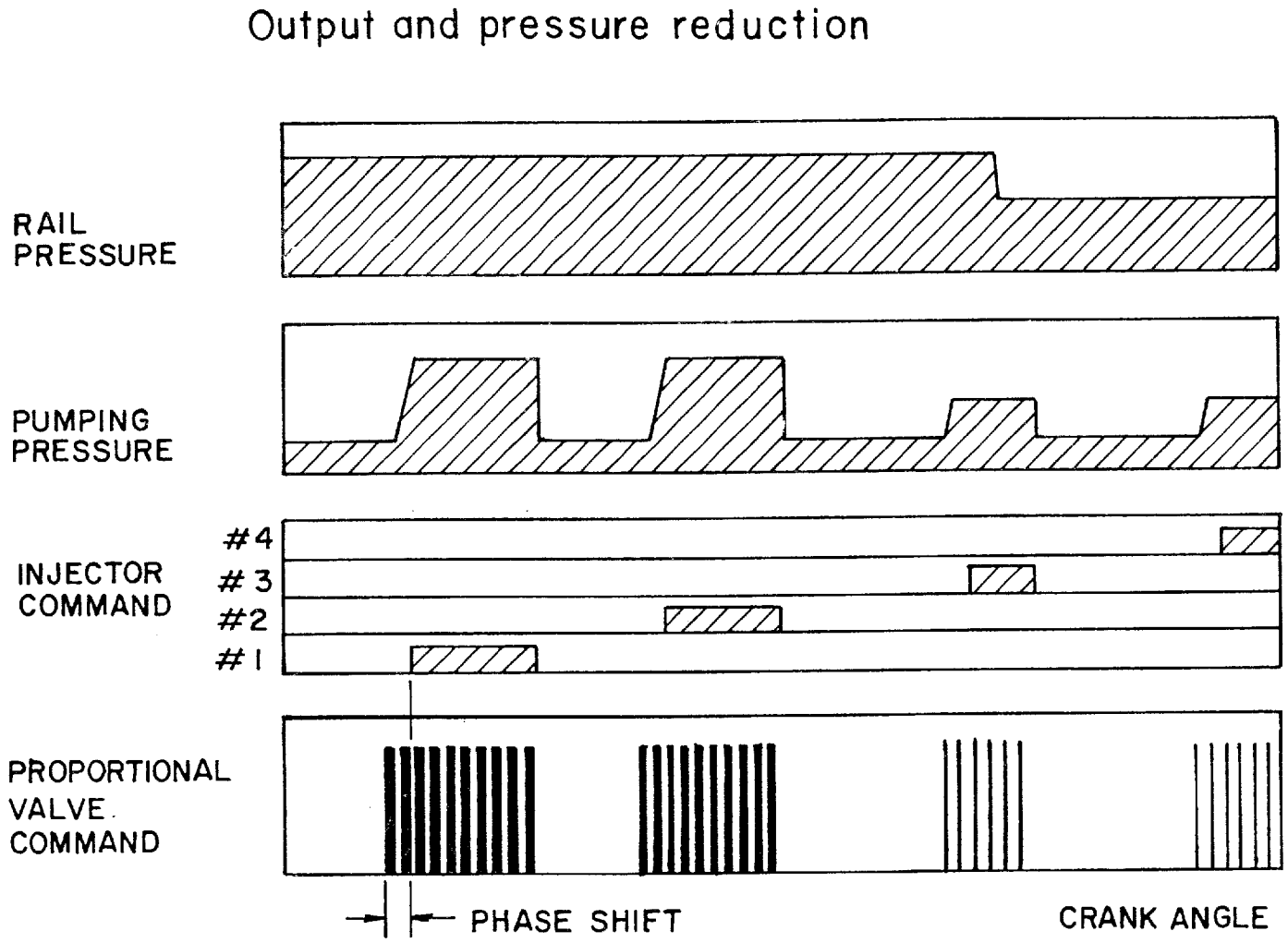
FIG. 9 is a diagrammatic representation of the behavior of the rail pressure, pumping pressure, injector command signal, and proportional control valve signal associated with a third control method, for the system of FIG. 8, according to the invention.
Figure 10:
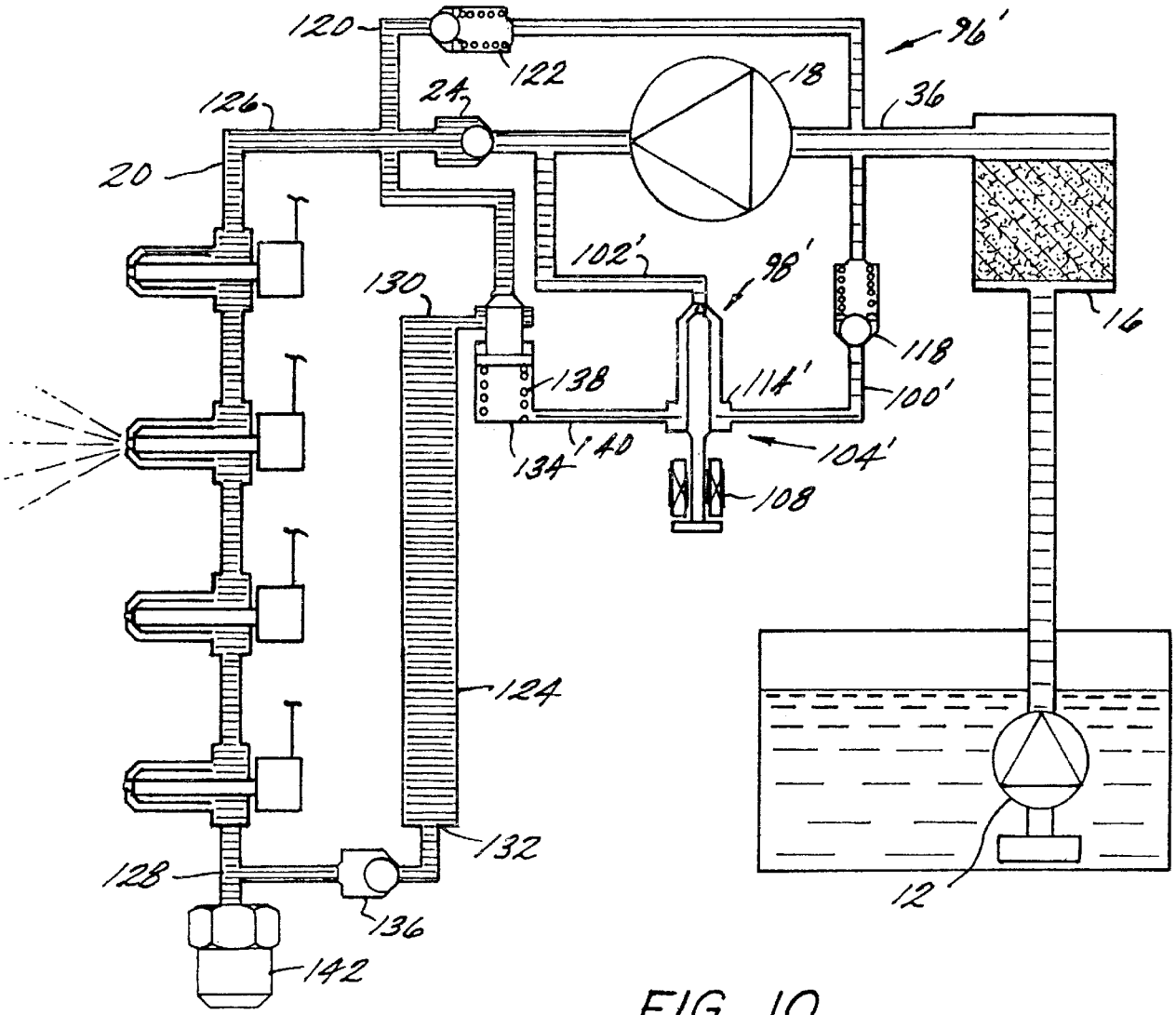
FIG. 10 is a schematic of another, enhanced embodiment of the system shown in FIG. 8.
Figure 11:
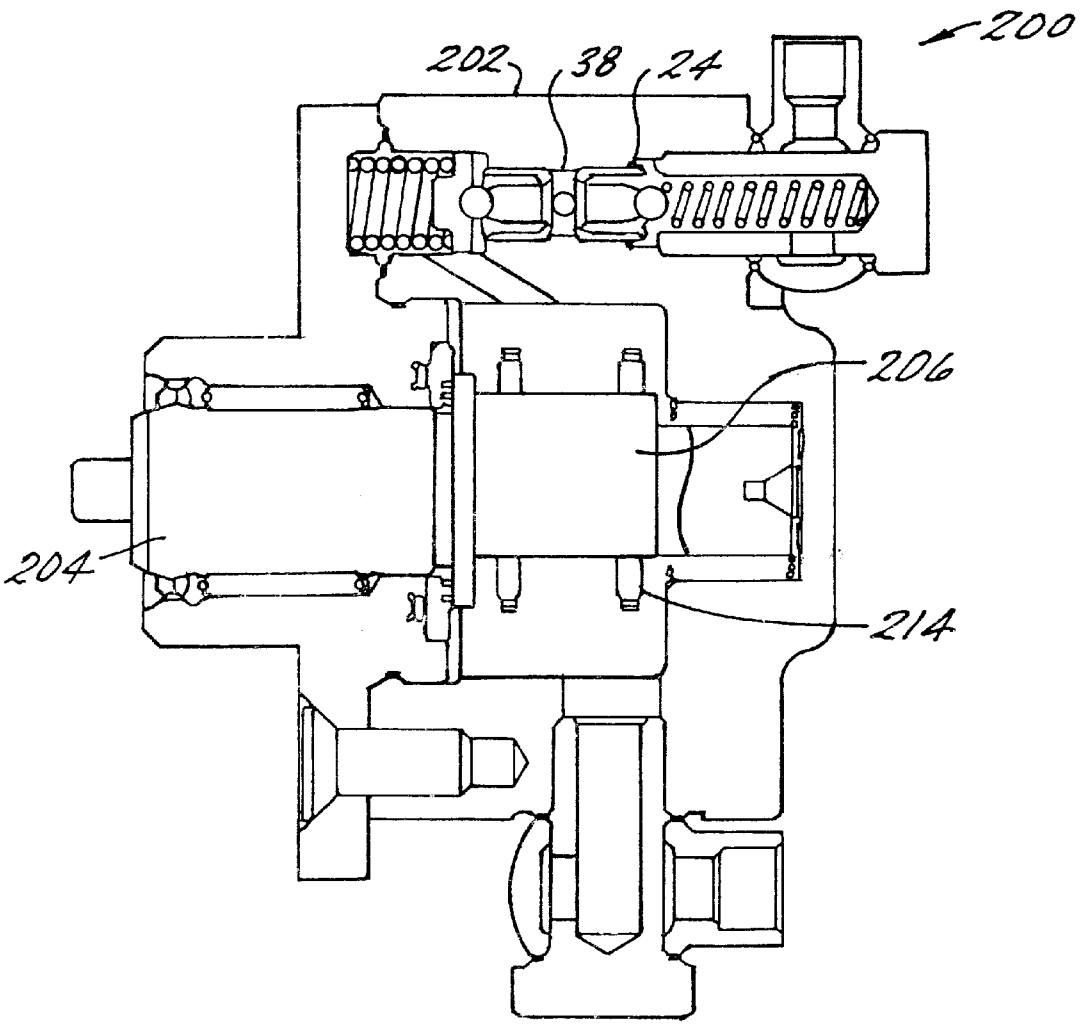
FIG. 11 is simplified, longitudinal section view of a high pressure pump for implementing the system schematic shown in FIG. 8.
Figure 12:
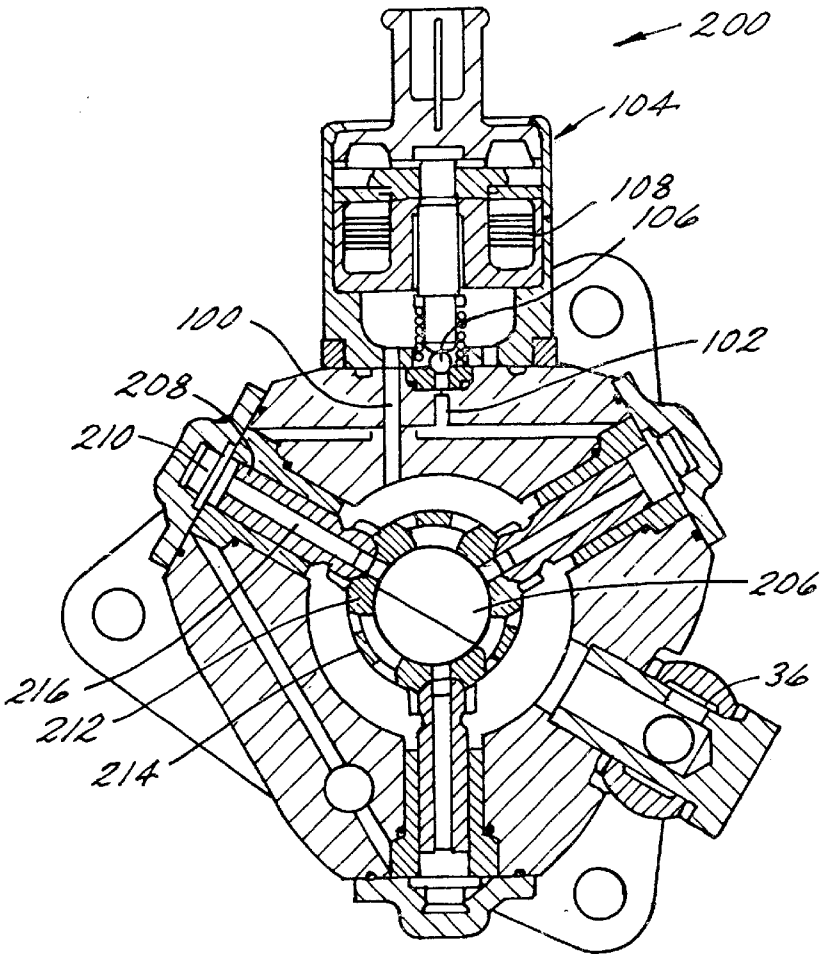
FIG. 12 is a simplified, cross sectional view of the high pressure pump shown in FIG. 11.

A schematic of the preferred embodiments 96 and 96' are shown in FIGS. 8 and 10, and a schematic of the preferred mode of operation is shown in FIG. 9. The primed numeric identifiers in FIG. 10 correspond to the unprimed counterparts in FIG. 8 and only the unprimed will be referred to for convenience. FIGS. 11 and 12 show an example of a hardware implementation, in a configuration similar to that described in U.S. patent application Ser. No. 09/031,859. Only the features of the pump 200 necessary to illustrate the present invention are described herein; the disclosure of that application can be referred to if additional details are desired.

The pump high pressure output timing is controlled directly by a solenoid valve 104. During the solenoid off-time the spring 116 biases the valve needle 106 against the hole 112 and associated seat, restricting flow from discharge control passage 102. This determines the pump pressure between injections. The pressure is preferably maintained at between 10 to 30 bars. This pressure ensures that there are no torque reversals at any given time, and it can also be used for a "limp home" operation of the engine, in case there are problems in the pressure control circuit (faulty pressure transducer, faulty or disconnected pressure control valve etc.). The spring 116 can alternatively be replaced by a spring and sphere valve 118 or the like, for biasing the valve member against the valve seat with an equivalent preload, as shown in FIG. 10. In this embodiment, a bypass passage 120 fluidly connects the pump inlet passage 36 with the common rail 20 downstream of the non-return check valve 24. Means such as a check valve 122 are provided in the bypass passage 120 for preventing flow therein except when the pressure in the common rail exceeds a maximum permitted limit. This limits the pressure increase in the rail caused by, e.g., mechanical problems or thermal expansion.

The hole 112 of the valve body 110 is exposed to the discharge control passage 102 and the space 114 within the body surrounding the needle member 106 is exposed to the inlet control passage 100. The pressure control solenoid 108 is energized shortly before any of the fuel injectors are actuated, resulting in a very rapid pumping pressure increase. Injection takes place during this high pressure pumping phase. The spring (116, 118) and solenoid forces then define the instantaneous pumping pressure. The effective flow resistance of the hydraulic circuit 98 and therefor the effect on the discharge pressure of the pump, can be controlled for a given duty cycle (valve member stroke) by controlling the frequency density and duration of the strokes.

In FIG. 9, the first two valve commands each contain, for example, ten equally timed, discrete voltage pulses tending to induce hovering of the valve toward opening and closing, but substantially no net movement of the valve, over a time interval slightly longer than the respective first two injector command intervals. The valve does not seat during such hovering. The second two valve commands contain six equally timed discrete pulses over a time interval slightly shorter than the respective first two injector commend intervals. The line densities in the command signals represent control of average current. Higher duty cycle means higher pumping pressure and vice versa. The injector commands, the associated pumping discharge pressure to the rail, and the rail pressure can thus be adjusted with considerable flexibility and precision using the preferred control circuit of the present invention.

However, the pressure in the rail will remain more or less constant, because at that time there is no demand for fuel and the non-return check valve separates the rail from the pumping circuit.

All the fuel displaced by the pump is then re-circulated back into the pump housing at the lower pressure level. The pump remains relatively cool even during extended periods of re-circulation. Because all pumping chambers are always fully filled, pressure increase is almost instantaneous. Despite the output variations the pump operation remains very quiet at all speeds.

The pump 200 has a housing 202 (which may consist two or more components such as body and cover, etc.). A drive shaft 204 penetrates the housing and carries an eccentric 206 located in a cavity within the housing. A plurality of radially oriented pumping plungers 208 are connected via sliding shoes 212 and actuating ring 214 for radial reciprocation as the eccentric rotates. Feed fuel at low pressure fills the cavity from inlet passage 36 and is delivered via supply passage 216 within each piston to the high pressure-pumping chamber 210. The highly pressurized fuel discharges into passage 38, where it encounters check valve 24. The inlet control passage 102 discharge control passage 100, injector-type control valve 104, valve needle member 106, and solenoid 108 of the hydraulic circuit of FIG. 8 are also evident.

In the embodiment of FIG. 10, a split accumulator 124 for the common rail 20 is additionally featured. The selection of the volume of the accumulator is very critical and it is a result of a compromise between two contradictory requirements. A small accumulator volume provides fast response during transients and also fast pressure build up. This is especially important for systems requiring elevated pressure (30 to 40 bar) at cranking, because of low pump output (versus time) and also because generally the leakage tends to increase at low speed. It is, however, far less critical at any of the normal operational points, because of substantial higher speed (ranging from 850+/−RPM at idle to 6000+ RPM at rated speed). Large accumulator volume reduces pressure fluctuation (both hydraulic noise and pressure drop during fuel withdrawal).

The split accumulator design divides the effective accumulation volume in two portions, separated by two check valves; one no return valve and one valve preset for certain opening pressure, for example 50 bar. The common rail 20 has first and second ends 126, 128 and the fuel injectors are connected thereto between the first and second ends. The accumulator 1 24 has a first end 130 fluidly connected to the first end of the common rail after the non-return check-valve 24 and a second end 132 fluidly connected to the second end 128 of the common rail. A preloaded check valve 134 preset for a particular opening pressure is situated at the first end 130 of the accumulator to receive flow into the accumulator when opened, and is biased in the closed position toward the first end 126 of the common rail. A no return check valve 136 is situated at the second end 132 of the accumulator, to permit flow out of the accumulator and to close toward the accumulator. The preloaded check valve can be set for an opening pressure above 30 bar, only by spring 138 or as a variable dependent on the pressure in passage 140, which is in fluid communication with the inlet control passage 100'. The preloaded check valve is preferably set for an opening pressure of about 50 bar. A pressure transducer 142 may be connected at the second end 128 of the common rail.

During cranking the engine is driven by the starter motor at, for example, 100 to 200 RPM. Because of substantial amount of fuel used for injection, the pressure will remain below the opening pressure of the valve 134 and all the fuel supplied by the high pressure pump 18 can be injected. This will lead to rapid engine firing and subsequent rapid speed increase. The engine speed will quickly reach at least idle speed (700 to 900 RPM) and this speed can be sustained by injecting only a fraction of the fuel delivered by the pump. The excess fuel will cause the pressure to increase and ultimately the valve 134 will open and because of active area increase (the backside of the valve is vented into the low-pressure circuit via passage 140) it will stay open until the engine is shut off again. From that point on, a larger accumulator volume will be available, resulting in reduced pressure fluctuation. During the fuel withdrawal the fuel will be supplied to the smaller portion of the rail 20 from both sides (one portion coming from the pump 18 and the balance coming from the accumulator through the no return check valve 136 (flowing in the reversed direction) providing more uniform pressure signature in the rail.

Figure 13:
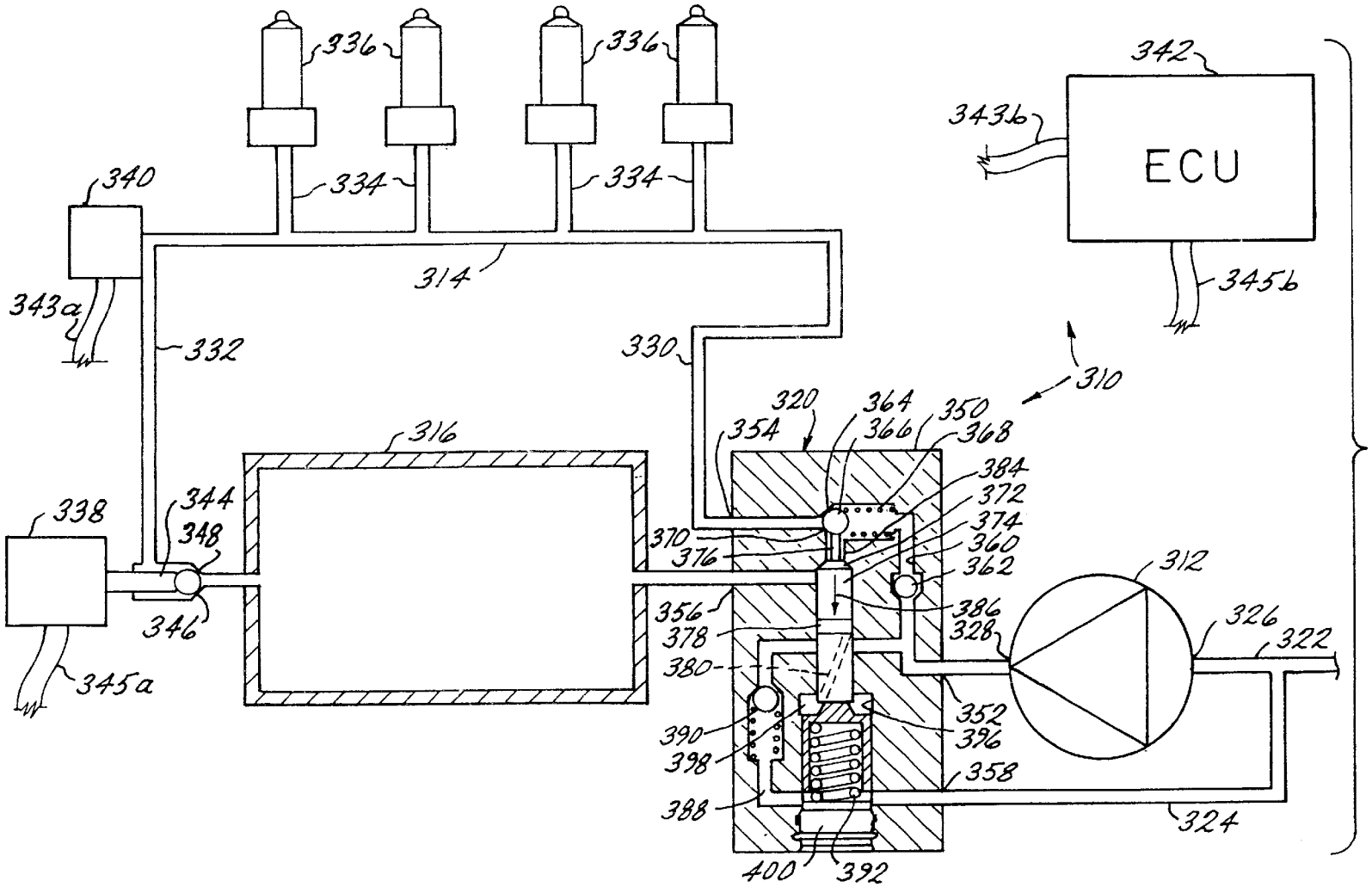
FIG. 13 is a diagrammatic representation of another embodiment of a direct injection system according to the invention.

A direct injection system in accordance with another embodiment of the present invention is illustrated, generally, at 310 in FIG. 13. The direct injection system 310 comprises a high-pressure fuel supply pump 312, distributor 314, accumulator 316, pressure control valve 338 and a flow control valve 320.

The high pressure fuel supply pump 312 may be similar to the high pressure fuel supply pump 18 discussed above in connection with FIG. 1 and is supplied by fuel via a feed line 322. The feed line 322 communicates with an electric feed pump (not shown) in a manner described above and a return line 324 connects to the feed line 322. The feed supply pump 312 includes an inlet side 326 and a discharge side 328.

The distributor 314 comprises feed lines 330 and 332 and extension lines 334. Both feed lines 330 and 332 communicate with the accumulator 316. The extension lines 334 each function to supply fuel to a fuel injector 336 which may be similar to those discussed above.

The distributor 314 and accumulator 316 function as a split accumulator similar to that discussed above with respect to FIG. 10. In this way, only a relatively small volume of fuel is demanded from the pump 312 to fill the distributor 314 during cranking of an engine (not shown). The distributor is sized to contain a volume of fuel that ranges between about 7 and 10 cm3 and is smaller than the accumulator volume, which is preferably at least twice the distributor volume, e.g., in the range of 30–50 cm3. At normal operating of the engine, the pump 312 will generate sufficient quantities of fuel at a pressure, e.g., above 40 or 50 bar to supply the larger volume of accumulator 316 and maintain the pressure therein above, e.g., about 40 bar.

The supply of the fuel for injectors 336 from the accumulator 316 at an appropriate pressure is accomplished via a pressure control valve 338, a pressure transducer 340 and an electronic control unit 342. The pressure transducer 340 measures fuel pressure within the distributor 314 and provides this information through line 343 *a, b* to the electronic control unit 342 which controls opening and closing of the pressure control valve 338. Pressure of the fuel in the accumulator 316 is measured by another pressure transducer (not shown) e.g., incorporated within the pressure control valve 338 and communicating with the electronic control unit 342 via line 345 *a, b*. In this manner, fuel pressure in the distributor 314 and that in the accumulator 316 is monitored by the electronic control unit 342 so that when the pressure in the accumulator exceeds that of the distributor by a predetermined amount (as fuel is injected and the pressure in the distributor drops), such as a ten bar differential, the pressure control valve 338 allows passage of fluid through the feed line 332 to the distributor 314. To accomplish the foregoing, the pressure control valve 338 is preferably a variable position, e.g., proportional solenoid valve employing a plunger 344 for pressing a sphere or ball 346 into contact with a valve seat 348. Similarly, a target pressure or pressure range can be maintained in the distributor.

The flow control valve 320 comprises a body 350 having an inlet 352, a first outlet 354, and a second outlet 356 and a third outlet 358. A first flow path is established between the pump 312 and the distributor 314 through the flow control valve 320 via inlet 352 and first outlet 354 which connects to feed line 330. A second flow path is established between the pump 312 and the distributor 314 through the flow control valve 320 via inlet 352 and outlet 356, through accumulator 316 and past the pressure control valve 338. Each of the first and second flow paths may be said to provide a supply flow path between the pump 312 and, ultimately, the distributor 314. A bypass flow path is established between discharge 328 and the inlet 326 of the pump 312 via the flow control valve inlet 352 and outlet 358 which is connected to the return line 324.

Between the inlet 352 and first outlet 354 a first passage way 360 extends. The first passage way 360 includes a check valve 362 and a first control valve 364 having a first operator e.g., a ball 366 and a spring 368. A seat 370 is provided for receiving the sphere 366.

A second control valve 372 is disposed in axial alignment with the first control valve 364 and comprises a second operator e.g., a cylindrical member 374, including a extension member 376, groove 378 and bore 380. The extension member 376 is engageable with the ball 366 as described in more detail below and is disposed within a second passage 382 which communicates with the second outlet 356. The cylindrical member 374 engages a seat 384 for preventing flow of fuel through second passage 382.

When the cylindrical member 374 moves in the direction of arrow 386 the groove 378 will align with another passage 388 which communicates with the third outlet 358. Disposed within the passage 388 is a pressure limiter valve 390.

The cylindrical member 374 is biased by a spring 392 disposed within a piston 394, which in turn, is disposed within a well 396. The bore 380 communicates with the well 396 in order to provide additional pressure from fuel useful in assisting to compress the spring 392. An aperture 398, which has a substantially smaller cross sectional area then that of the bore 380, extends through piston 394 to allow bleed off of fuel from the well 396 into the passage 388. A suitable plug 400 is provided for securing the first control valve 364 and second control valve 372 within the valve body 350.

The operation of the flow control valve will now be described with reference to FIGS. 14*a* through 14*e* which illustrate in sequence movement of the first control valve 364 and second control valve 372 and the flow of fuel through the flow control valve 320. FIG. 14*a* illustrates the orientation of the flow control valve 320 during cranking of the engine (not shown). As illustrated, the ball 366 is moved off center toward adjacent a wall 402, a portion of the seat 370 by the extension member 376 of the cylindrical member 374. Accordingly, fuel flows around the extension member 376 and past the ball 366 in the direction of arrow 404 and out the first outlet 354. The fuel pressure at the first outlet 354 may range from a nominal 4 bar (fuel pressure from the low-pressure fuel pump in the fuel tank) to about 30 bar. The pressure at the second outlet 356 is a nominal 4 bar and the pressure at the third outlet 358 is also a nominal 4 bar.

Figure 14B:
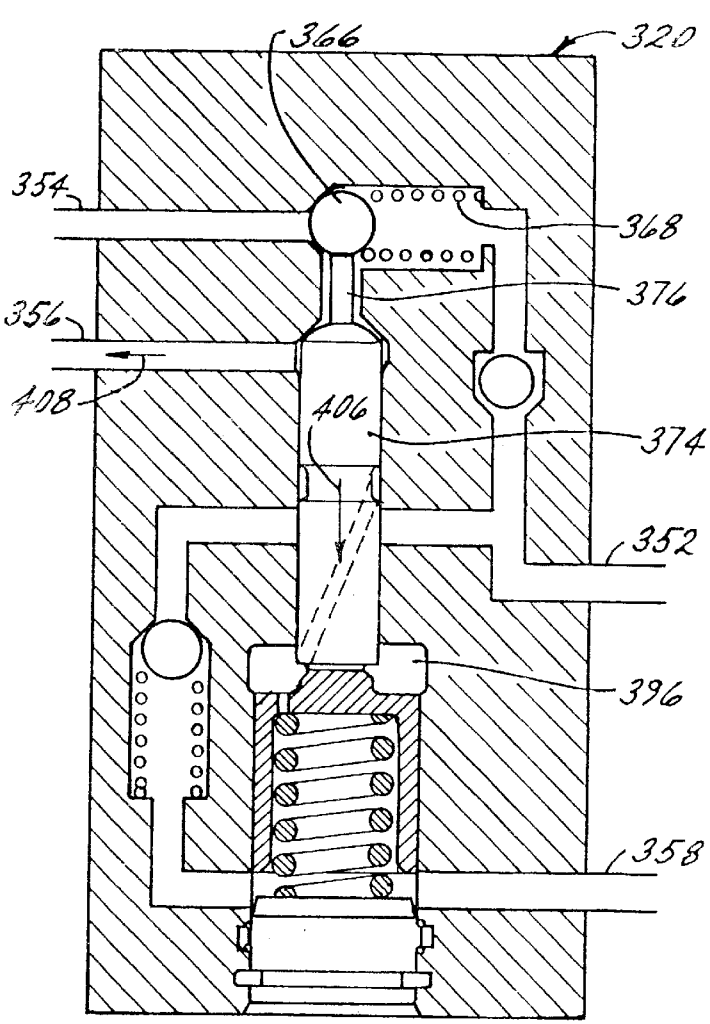
FIGS. 14*a*–14*f* are sequential views showing operation of a control valve in accordance with the embodiment of FIG. 13.
Figure 14A:
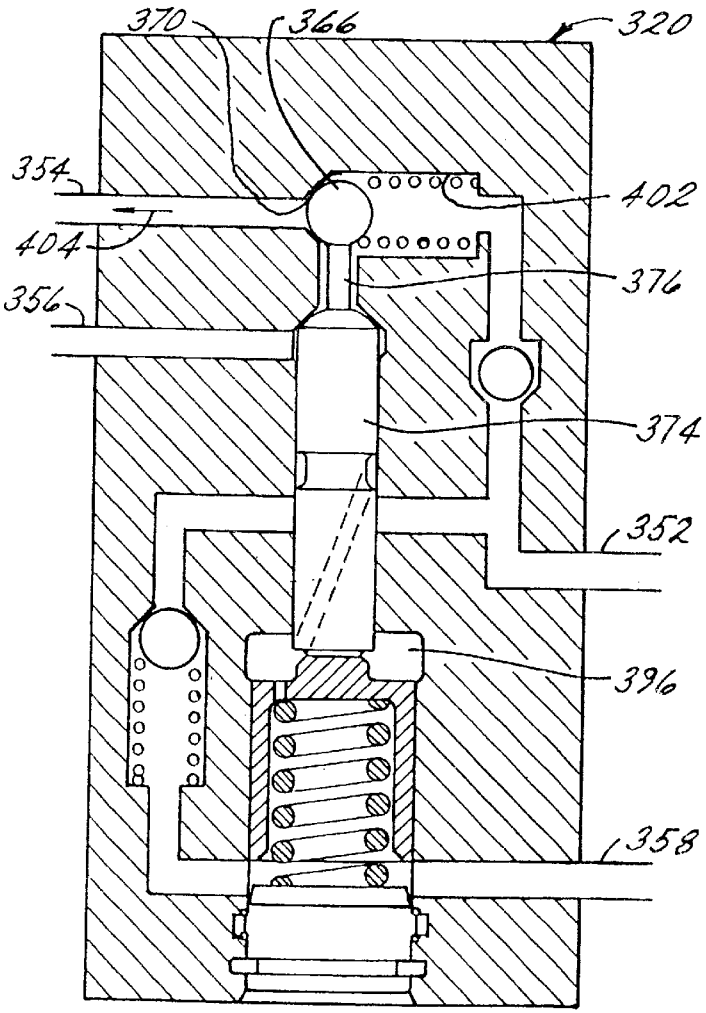

FIG. 14*b* illustrates the orientation of the flow control valve 320 after the engine has started. In particular, the cylindrical member moves in the direction of arrow 406 so that fuel may now flow past the cylindrical member 374 in the direction of arrow 408. The ball 366 moves under force of spring 368 and fuel adjacent seat 370. In this orientation of the valve, fuel pressure at the first outlet is between approximately 30 and approximately 80 bar, the pressure at the second outlet 356 is approximately 80 bar, and the pressure at the third outlet 358 is a nominal 4 bar. At this time, referring also to FIG. 13, the ECU 342 senses a pressure differential sufficient to being opening the pressure control valve 338 as described above.

Figure 14D:
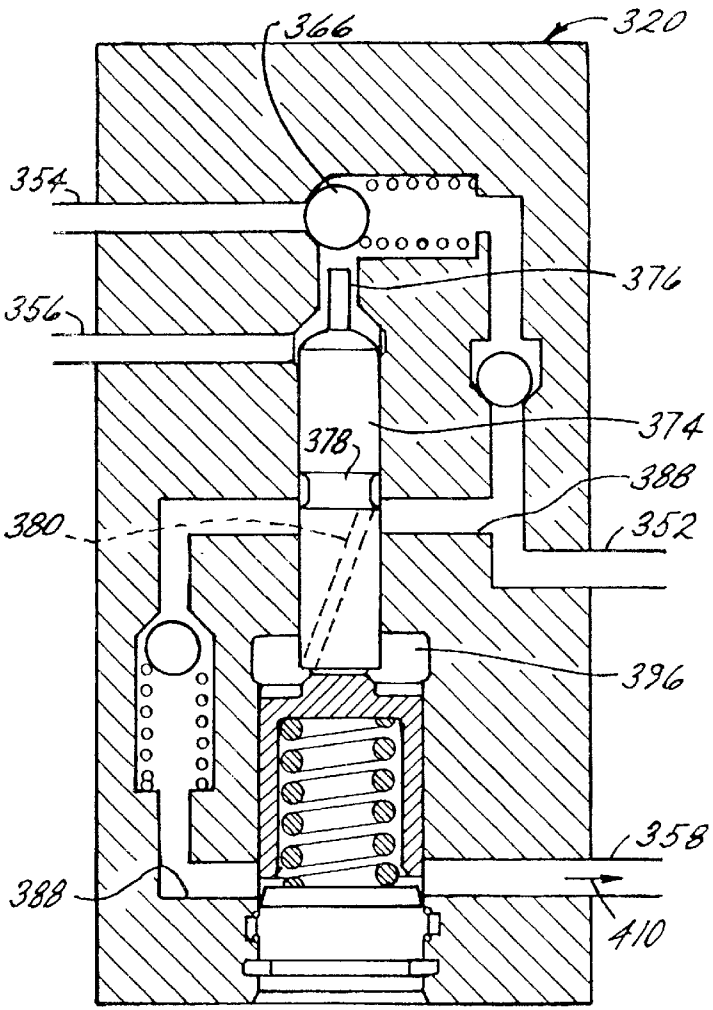
Figure 14C:
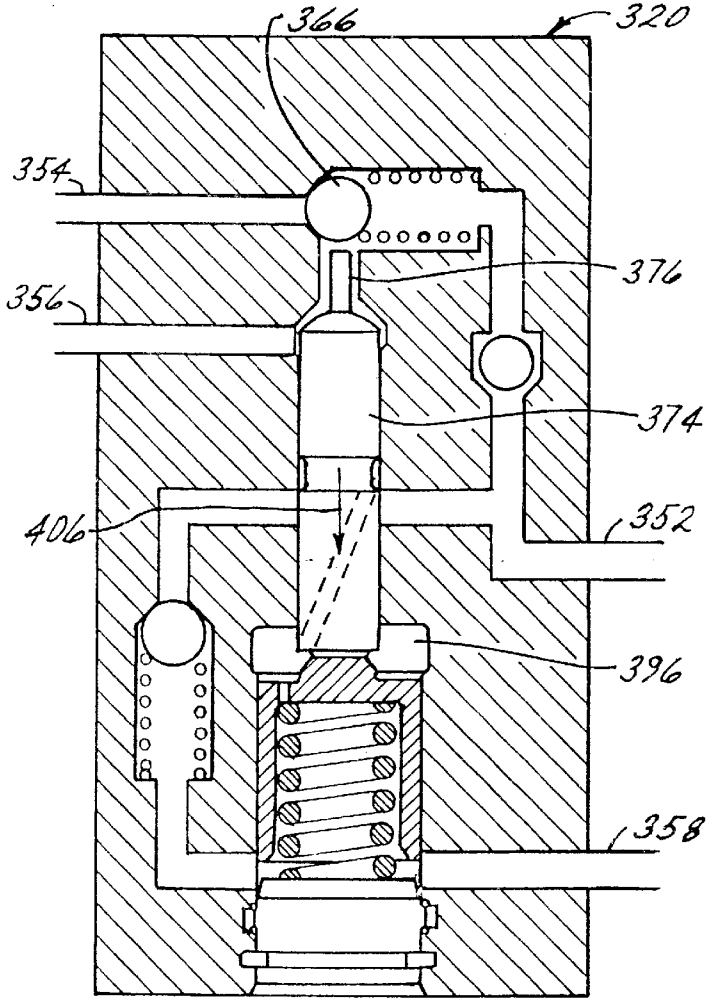
Figure 14F:
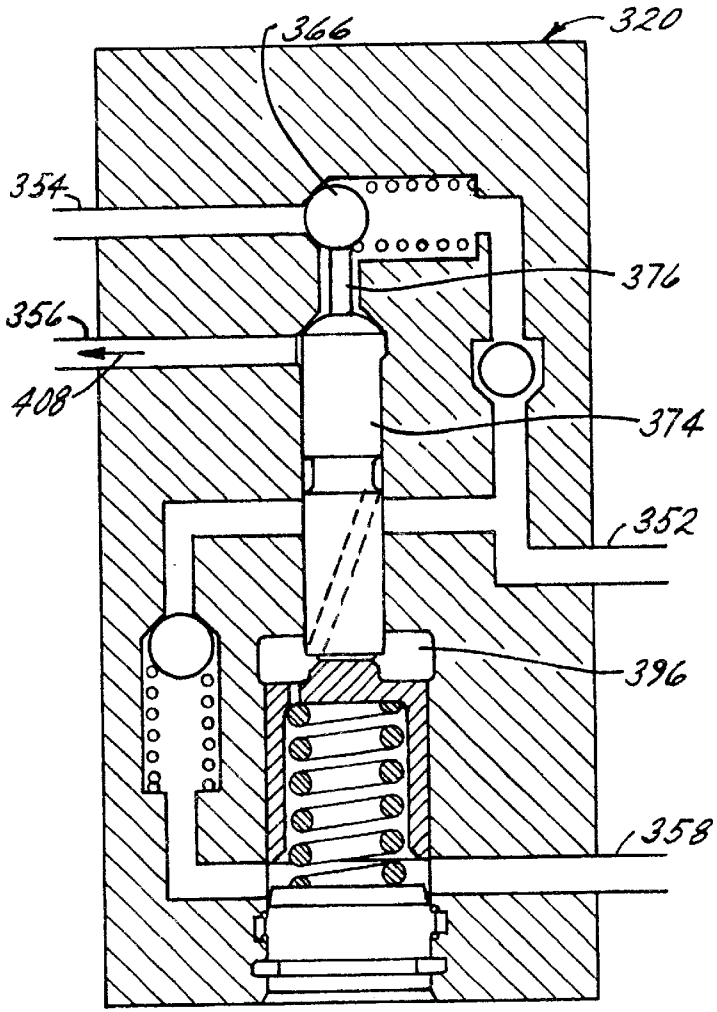
Figure 14E:
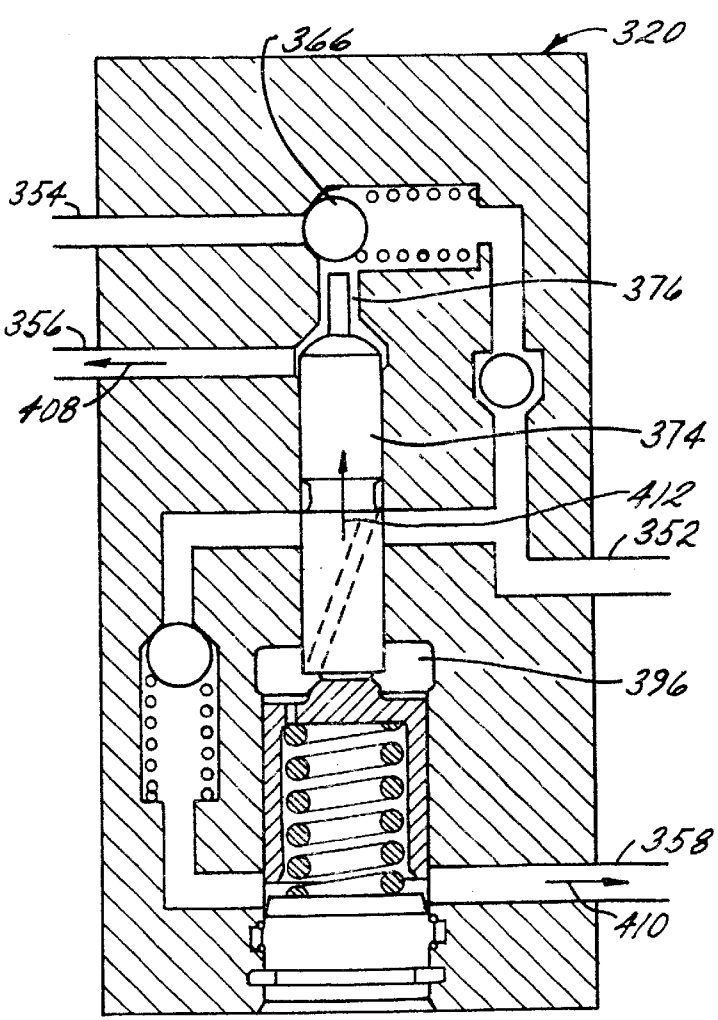

FIG. 14*c* shows the orientation of the flow control valve 320 in the situation where the accumulator has been charged to a pressure of about 120 bar. In such a situation, the cylindrical member 374 is urged further in the direction of arrow 406 as illustrated. The fuel pressure at the first outlet 354 is selectively controlled by valve 338 in the range between 30 and 100 bar about; 120 bar is present at the second outlet 356; and the third outlet 358 is at a nominal 4 bar. The fuel pressure at the inlet 352 generated by the supply pump 312 may be about 130 bar.

As illustrated in FIG. 14*d*, the engine may be at a steady state cruising speed whereupon fuel flows through the passageway 388 and past groove 378 whereupon fuel may flow outwardly of the third outlet 358 in the direction of arrow 410. Fuel also enters bore 380, well 396, aperture 398 and again into passageway 388. At this time the fuel pressure associated with the first outlet 354 is selectively controlled by valve 338 in the range between 30 and 100 bar, the fuel pressure associated with the second outlet 356 is approximately 125 bar, the pressure associated with the fuel within the well 396 is approximately 8 bar and the output pressure in the outlet 358 may be approximately 4 bar.

As illustrated in 14*e*, a demand for fuel in the accumulator 316 returns which causes movement in the cylindrical member 374 in the direction arrow 412 thereby returning flow of fuel outwardly of the second outlet 356 illustrated by arrow 408. The fuel pressure at the first outlet 354 is selectively controlled by valve 338 in the range of about 30 to 100 bar, at the second outlet 356 it is approximately 100 bar, at the well 396 it is approximately 6 bar and at the third outlet 358 it is approximately 4 bar.

As illustrated in 14*f*, complete supply of the accumulator 316 (FIG. 13) occurs whereupon passage of fuel occurs out of the outlet 356 illustrated by arrow 408. The pressures are as follows: at outlet 354 is selectively controlled by valve 338 in the range of about 30 to 100 bar; at outlet 356 approximately 130 bar; at inlet 352 approximately 130 bar; at well 396 about 4 bar and at the third outlet 358 approximately 4 bar.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. A direct injection fuel delivery system for a motor vehicle, comprising:

a common rail including an accumulator having a relatively large fuel volume connected in fluid communication with a distributor having a relatively small fuel volume;

at least one fuel injector nozzle connected in direct fluid communication with the distributor;

a high pressure pump for delivering fuel to the common rail; and flow control means interposed between the pump and the common rail for selectively delivering fuel to one of the accumulator or the distributor and then the other of the accumulator or the distributor.

2. The system of claim 1, wherein the flow control means controls both a first flow path between the pump and the distributor and a second flow path between the pump and the accumulator for selectively delivering fuel to one of the distributor and accumulator, respectively; and a pressure control valve is situated in a third flow path between the accumulator and the distributor which defines said fluid communication therebetween, said pressure control valve preventing flow from the distributor to the accumulator but permitting flow from the accumulator to the distributor when the pressure in the accumulator exceeds the pressure in the distributor by predetermine differential.

3. The system of claim 1, wherein the accumulator includes a pressure which ranges from 100 to 140 bar.

4. The system of claim 1 further comprising an engine having a cranking mode of operation and a running mode of operation and wherein the flow control means selectively delivers fuel to the distributor portion while the engine is cranking and thereafter while the engine is running alternatively delivers fuel to the accumulator and re-circulates fuel through the pump to bypass the common rail.

5. The system of claim 1, wherein said flow control means selectively delivers fuel to only the distributor when the fuel pressure in the common rail is below a predetermined value, and delivers fuel to the distributor and accumulator when the fuel pressure in the common rail is above said predetermined value.

6. The system of claim 2, wherein said flow control means selectively delivers fuel to only the distributor when the fuel pressure in the common rail is below a predetermined value, and delivers fuel to the distributor and accumulator when the fuel pressure in the common rail is above said predetermined value.

7. The system of claim 4, wherein in the running mode of operation the flow control means delivers fuel to both the distributor and accumulator in alternation with the recirculation of fuel through the pump to bypass the common rail.

8. A split rail fuel injector assembly for a motor vehicle including a high pressure fuel pump for delivering fuel to at least one fuel injector nozzle, the split rail fuel injector assembly comprising:

a distributor for distributing fuel, having a distributor internal volume, a distributor first inlet, a distributor second inlet and a distributor outlet to each fuel injector nozzle, the distributor first inlet being connected in fluid communication with the fuel pump and at least one fuel injector nozzle; and an accumulator having an accumulator internal volume and configured to receive fuel from the fuel pump and selectively pass fuel to the distributor via the distributor second inlet;

wherein the distributor internal volume is substantially less than the accumulator internal volume.

* * * * *